US009548143B2

(12) United States Patent
Sugiyama et al.

(10) Patent No.: US 9,548,143 B2
(45) Date of Patent: Jan. 17, 2017

(54) MULTIPAIR CABLE

(71) Applicant: Hitachi Metals, Ltd., Tokyo (JP)

(72) Inventors: Takahiro Sugiyama, Hitachi (JP); Hideki Nonen, Mito (JP); Osamu Seya, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/742,245

(22) Filed: Jun. 17, 2015

(65) Prior Publication Data

US 2015/0371736 A1 Dec. 24, 2015

(30) Foreign Application Priority Data

Jun. 24, 2014 (JP) ..... 2014-129303
May 8, 2015 (JP) ..... 2015-095478

(51) Int. Cl.

| | |
|---|---|
| ***H01B 11/04*** | (2006.01) |
| ***H01B 3/30*** | (2006.01) |
| ***H01B 11/20*** | (2006.01) |
| *H01B 13/04* | (2006.01) |

(52) U.S. Cl.
CPC ..... *H01B 3/30* (2013.01); *H01B 11/20* (2013.01); *H01B 13/04* (2013.01)

(58) Field of Classification Search
CPC ..... H01B 7/08; H01B 11/04
USPC ..... 174/117 F, 113 R
See application file for complete search history.

(56) References Cited

U.S. PATENT DOCUMENTS

| | | | | |
|---|---|---|---|---|
| 6,403,887 | B1 * | 6/2002 | Kebabjian | H01B 11/002 174/110 R |
| 6,452,107 | B1 * | 9/2002 | Kebabjian | H01B 11/002 174/113 R |
| 7,208,683 | B2 * | 4/2007 | Clark | H01B 11/04 174/110 R |
| 7,411,131 | B2 * | 8/2008 | Stutzman | H01B 11/1008 174/113 C |
| 8,569,627 | B1 * | 10/2013 | Salz | H01B 7/0892 174/102 R |
| 8,859,902 | B2 | 10/2014 | Matsuda et al. | |
| 2011/0139485 | A1 | 6/2011 | Matsuda et al. | |
| 2013/0248221 | A1 | 9/2013 | Booth et al. | |

FOREIGN PATENT DOCUMENTS

JP 2011-142070 A 7/2011

* cited by examiner

*Primary Examiner* — Chau N Nguyen
(74) *Attorney, Agent, or Firm* — McGinn IP Law Group, PLLC.

(57) ABSTRACT

A multipair cable includes an inner layer part including two differential signal transmission cables for an inner layer that are twisted together, a press winding tape wound around a periphery of the inner layer part, and an outer layer part including a plurality of differential signal transmission cables for an outer layer that are wound around an outer periphery of the press winding tape. The inner layer part further includes a buffer tape disposed between the two differential signal transmission cables.

20 Claims, 4 Drawing Sheets

MULTIPAIR CABLE

The present application is based on Japanese patent application Nos. 2014-129303 and 2015-095478 filed on Jun. 24, 2014 and May 8, 2015, respectively, the entire contents of which are incorporated herein by reference.

BACKGROUND of the INVENTION

1. Field of the Invention

This invention relates to a multipair cable.

2. Description of the Related Art

A multipair cable is known which has multiple differential signal transmission cables.

In the multipair cable with the multiple differential signal transmission cables, it is desired that the differential signal transmission cables are twisted together so as to be easily bent. If the number of the differential signal transmission cables becomes larger, a multilayer structure is generally formed in which the multiple differential signal transmission cables are twisted together so as to form an inner layer part and then multiple differential signal transmission cables are further wound around the outer periphery of the inner layer part so as to an outer layer part.

For example, generally in a multipair cable for four-channels, which has in total eight differential signal transmission cables i.e., four cables for transmission and four cables for receiving, two differential signal transmission cables are twisted together so as to form the inner layer part and then six differential signal transmission cables are spirally wound around the outer periphery of the inner layer part so as to the outer layer part.

The related arts to the invention may include JP-A-2011-142070.

SUMMARY OF THE INVENTION

The multipair cable for four-channels may have a problem that the two differential signal transmission cables used for the inner layer part are twisted together so as to be directly brought into contact with each other, thus the two differential signal transmission cables used for the inner layer part are inevitably arranged adjacent to each other in the longitudinal direction of the cable, so that electromagnetic field leaked from one differential signal transmission cable easily has an influence on another differential signal transmission cable, and an influence of crosstalk is increased.

It is an object of the invention to provide a multipair cable that is capable of reducing an influence of crosstalk.

(1) According to one embodiment of the invention, a multipair cable comprises:

an inner layer part comprising two differential signal transmission cables for an inner layer that are twisted together;

a press winding tape wound around a periphery of the inner layer part; and an outer layer part comprising a plurality of differential signal transmission cables for an outer layer that are wound around an outer periphery of the press winding tape, wherein the inner layer part further comprises a buffer tape disposed between the two differential signal transmission cables for the inner layer.

In the above embodiment (1) of the invention, the following modifications and changes can be made.

(i) The differential signal transmission cables each comprise two signal wires arranged in parallel to each other, and an insulator covering the two signal wires integrally or separately, and wherein the two differential signal transmission cables for the inner layer are arranged such that center lines thereof which are respectively equidistant from the two signal wires do not coincide with each other in a cross-sectional view.

(ii) The buffer tape is arranged in a cross-sectional view in an S-shape configured such that one side end part thereof is disposed along an outer peripheral surface of one of the differential signal transmission cables for the inner layer, and another side end part thereof is disposed along an outer peripheral surface of another of the differential signal transmission cables for the inner layer.

(iii) The press winding tape is spirally wound around the periphery of the inner layer part, and wherein a twisting direction of the inner layer part and a winding direction of the press winding tape are opposite to each other.

(iv) The buffer tape comprises a foamed tape comprising a foamed resin.

(v) The buffer tape comprises a conductive material.

(vi) The press winding tape comprises a conductive material.

Effects of the Invention

According to one embodiment of the invention, a multipair cable can be provided that is capable of reducing an influence of crosstalk.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Hereinafter, the embodiment according to the invention will be explained according to the drawings.

(Whole Configuration of Multipair Cable)

Figure 1:
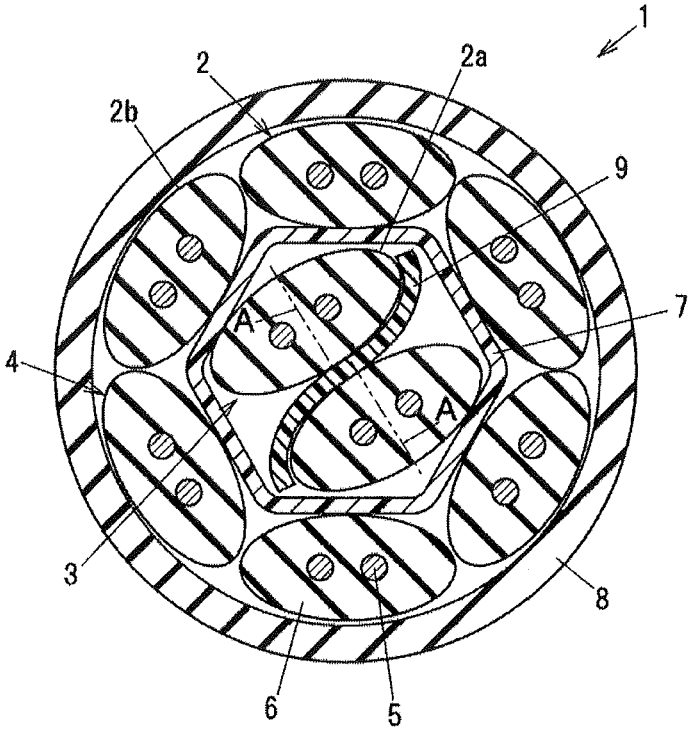
FIG. 1 is a transverse cross-sectional view schematically showing a multipair cable according to one embodiment of the invention.

FIG. 1 is a transverse cross-sectional view schematically showing a multipair cable according to one embodiment of the invention.

As shown in FIG. 1, a multipair cable 1 includes an inner layer part 3 including two differential signal transmission cables 2 for an inner layer that are twisted together, a press winding tape 7 wound around the periphery of the inner layer part 3 and an outer layer part 4 including a plurality of differential signal transmission cables 2 for an outer layer that are wound around the outer periphery of the press winding tape 7.

The differential signal transmission cables 2 include two signal wires 5 arranged in parallel to each other, and an insulator 6 covering the two signal wires 5 integrally or separately. Here, differential signal transmission cables 2 configured such that the insulator 6 covers the two signal wires 5 integrally are used. As the insulator 6, for example, one comprised of a foamed polyethylene can be used.

The differential signal transmission cables 2 are formed in an elliptic shape in a cross sectional view. Further, not limited to this, the differential signal transmission cables 2 may be formed in a race track shape (a shape composed of two parallel straight lines facing to each other and two semicircles connecting between end parts of the straight lines) in a cross sectional view. Hereinafter, the differential signal transmission cables 2 for the inner layer are referred as to an inner layer cores 2*a* and the differential signal transmission cables 2 for the outer layer are referred as to an outer layer cores 2*b*.

In the embodiment, two inner layer cores 2*a* are arranged such that the major axis directions thereof coincide with each other and are twisted together so as to form the inner layer part 3 and simultaneously six outer layer cores 2*b* are spirally wound (laterally wound) around the inner layer part 3 so as to form the outer layer part 4, as a result, the multipair cable 1 for four channels is formed, the multipair cable 1 being constituted of total eight differential signal transmission cables 2. The number of the outer layer cores 2*b* is, however, not limited to this. In addition, in the embodiment, a two-layer structure composed of the inner layer part 3 and the outer layer part 4 is used, but not limited to this, not less than three-layer structure configured such that the differential signal transmission cables 2 are further wound around the outer periphery of the outer layer part 4 may be adopted.

The press winding tape 7 is spirally wound around the periphery of the inner layer part 3. In the embodiment, as the press winding tape 7, a resin tape is used, the resin tape being constituted of an insulation resin and an adhesive layer formed on one surface of the insulation resin. The press winding tape 7 acts as a buffer layer when the outer layer cores 2*b* are wound around the outer periphery of the inner layer part 3 so as to prevent deformation of the inner layer cores 2*a*.

In the embodiment, the twisting direction of the inner layer cores 2*a* is set to the same direction as the winding direction of the outer layer cores 2*b*, but not limited to this, the opposite direction may be adopted. On the outer periphery of the outer layer part 4 outer layer part 4, a sheath 8 is disposed. Between the outer layer part 4 and the sheath 8, the press winding tape, the shield layer or the like may be appropriately disposed.

(Explanation of Buffer Tape)

In the multipair cable 1 according to the embodiment, a buffer tape 9 is disposed between two inner layer cores 2*a*. The buffer tape 9 is twisted together with the inner layer cores 2*a* so as to constitute a part of the inner layer part 3.

By disposing the buffer tape 9, two inner layer cores 2*a* are indirectly brought into contact with each other via the buffer tape 9 so as to increase a distance between both of the inner layer cores 2*a*, thus it is prevented that electromagnetic field leaked from one inner layer core 2*a* has an influence on another inner layer core 2*a*, so that an influence of crosstalk can be reduced.

In the embodiment, as the buffer tape 9, a foamed tape comprised of a foamed resin is used. The foamed resin used for the foamed tape includes, for example, a foamed polypropylene.

In addition, in the embodiment, the buffer tape 9 is arranged in a cross-sectional view in an S-shape configured such that one side end part thereof is disposed along the outer peripheral surface of one inner layer core 2*a*, and another side end part thereof is disposed along the outer peripheral surface of another inner layer core 2*a*. As the buffer tape 9, one is used that the width thereof is larger than the width of the inner layer cores 2*a* in the major axis direction, and the buffer tape 9 is arranged such that the side end part thereof extends at least to the center of the inner layer cores 2*a* in the minor axis direction.

In addition, in the embodiment, the two inner layer cores 2*a* are arranged such that the center lines A thereof which are respectively equidistant from the two signal wires 5 do not coincide with each other (deviate from each other in the major axis direction) in a cross-sectional view. In other words, the two inner layer cores 2*a* are arranged such that the centers thereof in the major axis direction and the minor axis direction do not face to each other. The buffer tape 9 is arranged in an S-shape in a cross-sectional view, thereby the positions of the two inner layer cores 2*a* are easily deviated from each other in the major axis direction, so that the center lines A of the two inner layer cores 2*a* hardly coincide in comparison with a case that the buffer tape 9 is not arranged. The advantageous effect obtained by preventing the coincidence of the center lines A of the two inner layer cores 2*a* will be described below.

(Explanation of Method for Manufacturing Multipair Cable 1)

Figure 2A:
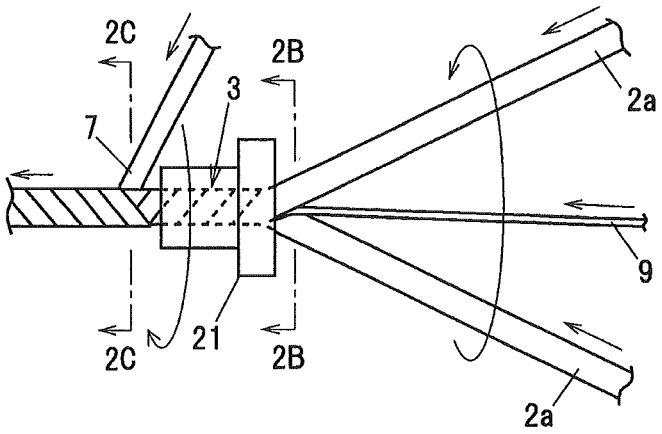
FIG. 2A is an explanatory view schematically showing a manufacturing method of the multipair cable shown in FIG. 1.
Figure 2B:
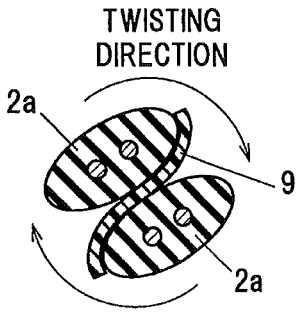
FIG. 2B is a cross-sectional view taken along the line 2B-2B in FIG. 2A.
Figure 2C:
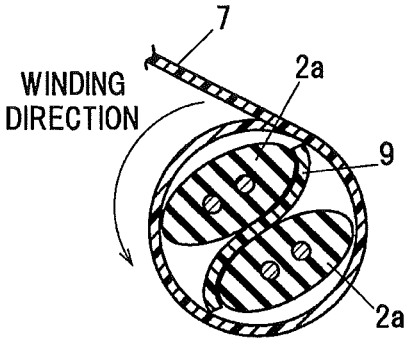
FIG. 2C is a cross-sectional view taken along the line 2C-2C in FIG. 2A.

As shown in FIGS. 2A to 2C, upon manufacturing the multipair cable 1, first, the two inner layer cores 2*a* and the buffer tape 9 are rotated while being fed to the dice 21 so as to form the inner layer part 3, and simultaneously the press winding tape 7 is spirally wound around the periphery of the inner layer part 3 pulled out from the dice 21. The press winding tape 7 is wound around the periphery of the inner layer part 3 pulled out from the dice 21, thereby the buffer tape 9 can be maintained in a form of the S-shape.

At this time, the twisting direction of the inner layer part 3 and the winding direction of the press winding tape 7 are set to an opposite direction to each other. The reason is that if the twisting direction of the inner layer part 3 and the winding direction of the press winding tape 7 are set to the same direction (namely if the press winding tape 7 is wound in the clockwise direction in FIG. 2C), the side end parts of the buffer tape 9 may be separated from the inner layer cores 2*a* so as not to be able to maintain the form of the S-shape.

After the press winding tape 7 is wound around the periphery of the inner layer part 3, the six outer layer cores 2*b* are wound around the periphery of the press winding tape 7 so as to form the outer layer part 4 and the sheath 8 is disposed around the periphery of the outer layer part 4, so that the multipair cable 1 according to the embodiment can be obtained.

(Effects Obtained by Preventing Coincidence of Center Lines A of Two Inner Layer Cores 2*a*)

Figure 3A:
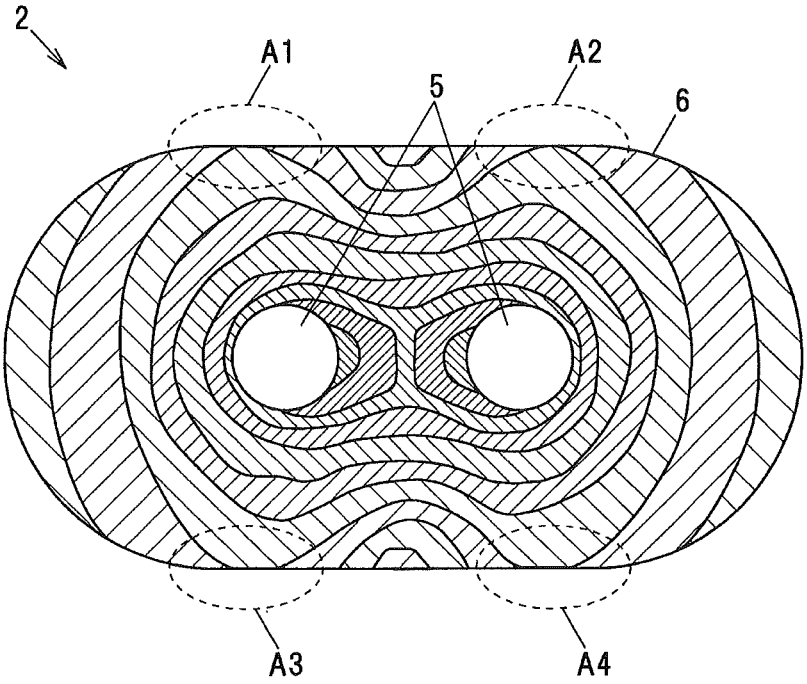
FIG. 3A shows a cross-section of a multi-pair illustrating, via hatching, the results of simulating a current component distribution in common mode of a differential signal transmission cable used as an inner layer core.
Figure 3B:
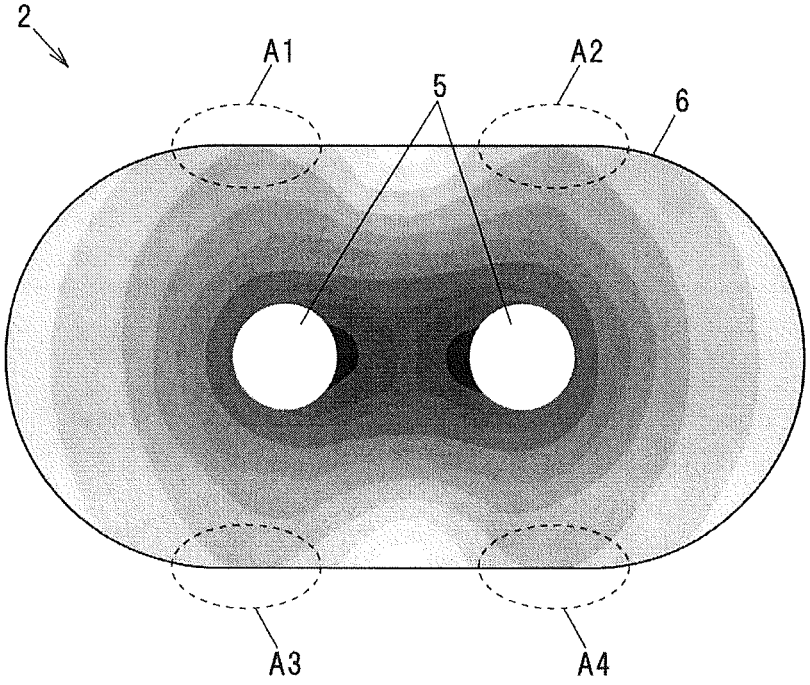
FIG. 3B shows the cross-section of the multi-pair illustrating, via gray-scale, the results of simulating the current component distribution in common mode of the cable of FIG. 3A.

FIG. 3A shows a cross-section of a multi-pair illustrating, via hatching, the results of simulating a current component distribution in common mode of the differential signal transmission cable 2 used as the inner layer core 2*a*. Also, FIG. 3B shows the cross-section of the multi-pair illustrating, via gray-scale, the results of simulating the current component distribution in common mode of the cable of FIG. 3A. It is to be noted that FIG. 3B shows the magnitude of the current component in common mode by the shading of a gray scale, and shows that the darker the shading becomes (the nearer the position to the signal wires 5 becomes), the larger the current component in common mode becomes.

As shown in FIGS. 3A and 3B, in the surface of the differential signal transmission cables 2 used as the inner layer cores 2*a* (in the outer surface of the insulator 6), the current component in common mode that causes the crosstalk is increased in the vicinity of the upper and lower positions of both of the signal wires 5, namely the positions corresponding to the signal wires 5 in the minor axis direction (regions A1 to A4 surrounded by broken lines in FIGS. 3A and 3B).

If both of the inner layer cores 2*a* are arranged such that the center lines A coincide with each other, there is a risk that parts thereof having the larger current component in common mode are arranged so as to be closest to each other while facing to each other, so that the crosstalk between the two inner layer cores 2*a* is increased.

In the embodiment, the two inner layer cores 2*a* are arranged such that the center lines A are deviated in the major axis direction so as to prevent the coincidence thereof, thereby the parts having the larger current component in common mode that causes the crosstalk are arranged so as to be apart from each other without facing to each other. Due to this, it becomes possible to further reduce the crosstalk.

It is to be noted that as one example, such a case has been shown here that the differential signal transmission cables 2 are used, the cables 2 having a structure that the current component in common mode is increased in the regions A1 to A4 corresponding to the upper and lower positions of both of the signal wires 5, but if the differential signal transmission cables 2 used as the inner layer cores 2*a* have a different structure, the positions in which the current component in common mode is increased become also different. For example, in case of the differential signal transmission cable 2 having a structure that the two signal wires 5 are individually covered with the insulator 6 and a drain wire is arranged between both of the insulators 6, there is a tendency that the current component in common mode is most increased in the periphery of the drain wire.

Even if the above-mentioned differential signal transmission cables having a different structure are used, if differential signal transmission cables having an identical structure as the two inner layer cores 2*a*, the current component in common mode in the two inner layer cores 2*a* is increased in the same positions (for example, in the above-mentioned regions A1 to A4, the periphery of the drain wire or the like). Thus, the two inner layer cores 2*a* are arranged such that the center lines A do not coincide with each other, thereby the positions in which the current component in common mode is increased are prevented from facing to each other, so that it becomes possible to reduce the crosstalk.

(Explanation of Action and Effect of the Embodiments)

As explained above, the multipair cable 1 according to the embodiment is configured such that the buffer tape 9 is disposed between the two inner layer cores 2*a*.

By disposing the buffer tape 9, the two inner layer cores 2*a* are prevented from being directly brought into contact with each other and the distance between the two inner layer cores 2*a* is increased, thus it becomes possible to reduce an influence of leakage electromagnetic field between the inner layer cores 2*a*, namely an influence of crosstalk.

In addition, in the embodiment, the two inner layer cores 2*a* are arranged such that the center lines A do not coincide with each other. As a result, it becomes possible to arrange both of the inner layer cores 2*a* such that the parts in which the current component in common mode is increased are arranged so as to be apart from each other without facing to each other, so that it becomes possible to further prevent an influence of the crosstalk without increasing the outer diameter of the cables. It is to be noted that the thickness of the buffer tape 9 can be appropriately adjusted in consideration with the allowable outer diameter of the cables and the like.

In addition, in the embodiment, the buffer tape 9 is arranged in an S-shape in a cross-sectional view, thus both of the inner layer cores 2*a* are easily arranged so as to prevent the coincidence of the center lines A.

The multipair cable 1 according to the embodiment can be applied to, for example, a router and a switch disposed in a data center or the like, a cable assembly used for a server, and a cable assembly (a direct attach cable) used for wiring of a personal computer, a hard disc or the like. In addition, the multipair cable 1 can be applied to a cable device such as an active cable. It is to be noted that the cable assembly means an article including a cable and connectors integrally disposed at both end parts of the cable, and the active cable means an article including a connector and a compensation circuit disposed in the connector, the compensation circuit being configured to actively compensate an electric signal in accordance with loss characteristics of the differential signal transmission cable so as to output it.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, in the above-mentioned embodiment, a case that a foamed tape is used as the buffer tape 9 has been explained, but not limited to this, a buffer tape having a shield function comprised of a conductive material may be used as the buffer tape 9. This leads to an electric shield between the inner layer cores 2*a*, thus it becomes possible to reduce an influence of the crosstalk. As the buffer tape 9 comprised of a conductive material, for example, a metal tape configured such that a metal layer is formed on one surface of a resin layer, a resin tape using a conductive resin, or the like can be used.

Further, in the above-mentioned embodiment, a case that a resin tape is used as the press winding tape 7 has been explained, but not limited to this, a press winding tape having a shield function comprised of a conductive material may be used as the press winding tape 7. This leads to an electric shield between the inner layer core 2*a* and the outer layer core 2*b*, thus it becomes possible to reduce an influence of the crosstalk between the inner layer core 2*a* and the outer layer core 2*b*. As the press winding tape 7 comprised of a conductive material, for example, a metal tape configured such that a metal layer is formed on one surface of a resin layer, a resin tape using a conductive resin, or the like can be used. It is to be noted that a configuration that a conductive tape is further wound around the outer periphery of the press winding tape 7 comprised of a resin tape may be adopted.

Summary of Embodiments

Next, technical ideas grasped from the above-mentioned embodiments will be described referring to reference signs and the like in the embodiments. It is to be noted that, however, each of the reference signs and the like in the following description does not limit the constituent elements in the scope of claims to members and the like shown in the embodiments specifically.

[1] A multipair cable (1), including an inner layer part (3) including two differential signal transmission cables (2) for an inner layer that are twisted together, a press winding tape (7) wound around the periphery of the inner layer part (3) and an outer layer part (4) including a plurality of differential signal transmission cables (2) for an outer layer that are wound around the outer periphery of the press winding tape (7), wherein the inner layer part (3) further includes a buffer tape (9) disposed between the two differential signal transmission cables (2) for the inner layer.

[2] The multipair cable (1) according to [1], wherein the differential signal transmission cables (2) each include two signal wires (5) arranged in parallel to each other, and an insulator (6) covering the two signal wires (5) integrally or separately, and wherein the two differential signal transmission cables (2) for the inner layer are arranged such that center lines thereof which are respectively equidistant from the two signal wires (5) do not coincide with each other in a cross-sectional view.

[3] The multipair cable (1) according to [1] or [2], wherein the buffer tape (9) is arranged in a cross-sectional view in an S-shape configured such that one side end part thereof is disposed along the outer peripheral surface of one of the differential signal transmission cables (2) for the inner layer, and another side end part thereof is disposed along the outer peripheral surface of another of the differential signal transmission cables (2) for the inner layer.

[4] The multipair cable (1) according to [3], wherein the press winding tape (7) is spirally wound around the periphery of the inner layer part (3), and wherein the twisting direction of the inner layer part (3) and the winding direction of the press winding tape (7) are opposite to each other.

[5] The multipair cable (1) according to any one of [1] to [4], wherein the buffer tape (9) includes a foamed tape including a foamed resin.

[6] The multipair cable (1) according to any one of [1] to [5], wherein the buffer tape (9) includes a conductive material.

[7] The multipair cable (1) according to any one of [1] to [6], wherein the press winding tape (7) includes a conductive material.

What is claimed is:

1. A multipair cable, comprising:

an inner layer part comprising two differential signal transmission cables for an inner layer that are twisted together;

a press winding tape wound around a periphery of the inner layer part; and an outer layer part comprising a plurality of differential signal transmission cables for an outer layer that are wound around an outer periphery of the press winding tape, wherein the inner layer part further comprises a buffer tape disposed between the two differential signal transmission cables for the inner layer, wherein a twisting direction of the inner layer part and a winding direction of the press winding tape are opposite to each other, and wherein the twisting direction of the two differential signal transmission cables in the inner layer part is the same as a winding direction of the plurality of differential signal transmission cables in the outer layer.

2. The multipair cable according to claim 1, wherein the differential signal transmission cables each comprise two signal wires arranged in parallel to each other, and an insulator covering the two signal wires integrally or separately, and wherein the two differential signal transmission cables for the inner layer are arranged such that center lines thereof which are respectively equidistant from the two signal wires do not coincide with each other in a cross-sectional view.

3. The multipair cable according to claim 2, wherein the two differential signal transmission cables for the inner layer are held by the buffer tape such that the center lines thereof, which are respectively equidistant from the two signal wires, do not coincide with each other in the cross-sectional view.

4. The multipair cable according to claim 2, wherein the two differential signal transmission cables for the inner layer are arranged such that the center lines thereof, which are respectively equidistant from the two signal wires, do not coincide with each other in the cross-sectional view along a longitudinal direction of the multipair cable.

5. The multipair cable according to claim 1, wherein the buffer tape is arranged in a cross-sectional view in an S-shape configured such that one side end part thereof is disposed along an outer peripheral surface of one of the differential signal transmission cables for the inner layer, and another side end part thereof is disposed along an outer peripheral surface of another of the differential signal transmission cables for the inner layer.

6. The multipair cable according to claim 5, wherein the press winding tape is spirally wound around the periphery of the inner layer part.

7. The multipair cable according to claim 1, wherein the buffer tape comprises a foamed tape comprising a foamed resin.

8. The multipair cable according to claim 1, wherein the buffer tape comprises a conductive material.

9. The multipair cable according to claim 1, wherein the press winding tape comprises a conductive material.

10. The multipair cable according to claim 1, wherein the cores of the two differential signal transmission cables in the inner layer contact an inner surface of the press winding tape.

11. The multipair cable according to claim 10, wherein the cores of the plurality of differential signal transmission cables in the outer layer contact an outer surface of the press winding tape.

12. The multipair cable according to claim 1, wherein the cores of the plurality of differential signal transmission cables in the outer layer abut an outer surface of the press winding tape.

13. The multipair cable according to claim 1, wherein an entirety of the buffer tape is spaced apart from the press winding tape.

14. A multipair cable, comprising:

an inner layer part comprising two differential signal transmission cables for an inner layer that are twisted together;

a press winding tape wound around a periphery of the inner layer part; and an outer layer part comprising a plurality of differential signal transmission cables for an outer layer that are wound around an outer periphery of the press winding tape, wherein the inner layer part further comprises a buffer tape disposed between the two differential signal transmission cables for the inner layer, wherein a twisting direction of the inner layer part and a winding direction of the press winding tape are opposite to each other, and wherein the twisting direction of the two differential signal transmission cables in the inner layer part is opposite to a winding direction of the plurality of differential signal transmission cables in the outer layer.

15. The multipair cable according to claim 14, wherein the differential signal transmission cables each comprise two signal wires arranged in parallel to each other, and an insulator covering the two signal wires integrally or separately, and wherein the two differential signal transmission cables for the inner layer are arranged such that center lines thereof which are respectively equidistant from the two signal wires do not coincide with each other in a cross-sectional view.

16. The multipair cable according to claim 15, wherein the two differential signal transmission cables for the inner layer are held by the buffer tape such that the center lines thereof, which are respectively equidistant from the two signal wires, do not coincide with each other in the cross-sectional view.

17. The multipair cable according to claim 15, wherein the two differential signal transmission cables for the inner layer are arranged such that the center lines thereof, which are respectively equidistant from the two signal wires, do not coincide with each other in the cross-sectional view along a longitudinal direction of the multipair cable.

18. The multipair cable according to claim 14, wherein the cores of the two differential signal transmission cables in the inner layer contact an inner surface of the press winding tape.

19. The multipair cable according to claim 18, wherein the cores of the plurality of differential signal transmission cables in the outer layer contact an outer surface of the press winding tape.

20. The multipair cable according to claim 14, wherein an entirety of the buffer tape is spaced apart from the press winding tape.

* * * * *